United States Patent [19]

Noeske

[11] 4,048,456

[45] Sept. 13, 1977

[54] PUFFER-TYPE GAS-BLAST CIRCUIT BREAKER

[75] Inventor: Heinz Otto Noeske, Cherry Hill, N.J.

[73] Assignee: General Electric Company, Philadelphia, Pa.

[21] Appl. No.: 672,822

[22] Filed: Apr. 1, 1976

[51] Int. Cl.[2] ..... H01H 33/70

[52] U.S. Cl. ..... 200/148 A

[58] Field of Search ..... 200/148 A, 150 G

[56] References Cited

U.S. PATENT DOCUMENTS

| | | | |
|---|---|---|---|
| 3,602,670 | 8/1971 | Teijeiro | 200/148 A |
| 3,659,065 | 4/1972 | Roidt et al. | 200/148 A |
| 3,739,125 | 6/1973 | Noeske | 200/148 A |
| 3,769,479 | 10/1973 | Leeds | 200/148 A |
| 3,940,583 | 2/1976 | Hertz | 200/148 A |
| 3,941,962 | 3/1976 | Thaler | 200/148 A |
| 3,946,180 | 3/1976 | Votta | 200/148 A |

*Primary Examiner*—Robert S. Macon
*Attorney, Agent, or Firm*—William Freedman

[57] ABSTRACT

This puffer-type circuit breaker comprises two electrodes between which an arc is established during interruption and a nozzle of insulating material containing a flow passage having a throat through which the arc extends. A plurality of injection passages extend generally radially of the nozzle in the throat region, and a plurality of feed passages communicate with the injection passages and extend through the body of the nozzle from one end of the nozzle to the injection passages. Pump means at said one end of the nozzle operates during interruption to inject arc-extinguishing gas through the feed passages and the injection passages into the throat. The injected gas flows axially of the arc in two streams directed in opposite directions from the throat toward the electrodes. The stream flowing toward the pump end of the nozzle is conducted to the exterior of the nozzle through a plurality of exhaust ports extending transversely of said flow passage in locations circumferentially spaced from said feed passages.

5 Claims, 4 Drawing Figures

PUFFER-TYPE GAS-BLAST CIRCUIT BREAKER

BACKGROUND

This invention relates to a gas-blast electric circuit breaker which relies upon a pump, or puffer, for forcing a blast of relatively cool gas into the arcing region of the breaker to promote arc extinction.

My U.S. Pat. No. 3,739,125, assigned to the assignee of the present invention, discloses and claims a puffer type circuit breaker comprising: (i) a pair of spaced electrodes between which an arc is established, (ii) a nozzle of insulating material having a throat through which the arc extends during interruption, and (iii) means for forcing a blast of arc-extinguishing gas into the arcing region during interruption.

Improved circuit interrupting performance is obtained in this circuit breaker by injecting the arc-extinguishing gas via a plurality of radially-extending injection passages leading into the throat of the nozzle and forcing this gas to flow axially of the arc in opposite directions from the throat toward the spaced electrodes.

In my aforesaid patent, the pump used for injecting the arc-extinguishing blast comprises a cylinder and piston surrounding the nozzle and defining an annular cylinder space also surrounding the nozzle. While such a cylinder and piston arrangement is relatively simple and is in a location where it does not interfere with the desired flow pattern for the arc extinguishing blast, an interrupter that utilizes such a pump is subject to certain disadvantages.

One such disadvantage is that this pump consumes a relatively large amount of space considered radially of the nozzle, and this requires that the interrupter housing have an unduly large diameter. Another disadvantage is that the parts of the pump, being situated between the spaced electrodes, must generally be of insulating material to avoid impairing the dielectric strength prevailing between the electrodes. This requirement results in a more expensive pump as compared to one that has mostly metal components.

Still another disadvantage of the aforesaid prior construction is that an involved linkage is needed for interconnecting the movable pumping element and the movable contact of the circuit breaker in order to actuate the pumping element in response to movement of the contact.

SUMMARY

An object of my present invention is to provide a puffer-type circuit breaker which is able to produce flow of the arc-extinguishing blast within the nozzle in accordance with the same basic flow pattern as in my aforesaid patented interrupter but yet is not subject to the abovenoted disadvantages associated with utilizing a pump surrounding the nozzle.

Another object is to construct a puffer-type electric circuit breaker in such a way that it is able to produce flow within the nozzle in accordance with the same basic flow pattern as in my aforesaid patented interrupter but yet utilizes a conventional pump at one end of the nozzle for developing the pressure for producing such flow.

In carrying out my invention in one form, I provide a puffer-type circuit breaker comprising a pair of electrodes, spaced apart during an interrupting operation, between which an arc is established, and a nozzle having a body primarily of electrical insulating material. Extending axially of the nozzle is a flow passage containing a throat of electrical insulating material through which the arc extends during an interrupting operation. A plurality of injection passages extend generally radially of the nozzle in the throat region and intersect the throat at the inner ends of the injection passages. A plurality of feed passages located within the nozzle body communicate with the injection passages and extend between the injection passages and one end of the nozzle. Pump means located at said one end of the nozzle is operable during a circuit-breaker opening operation to inject arc-extinguishing gas through said feed passages and said injection passages into the throat. Means is provided for forcing the gas injected into the throat to flow within the flow passage axially of the arc in opposite directions from the throat toward the electrodes. This latter means comprises a plurality of exhaust ports at said one end of the nozzle extending transversely of the flow passage from the flow passage to the exterior of the nozzle in locations circumferentially spaced from said feed passages. The inner ends of said exhaust ports are disposed in a region surrounding one of the electrodes.

BRIEF DESCRIPTION OF DRAWINGS

For a better understanding of the invention, reference may be had to the following drawings, wherein.

DETAILED DESCRIPTION OF PREFERRED EMBODIMENT

Figure 1:
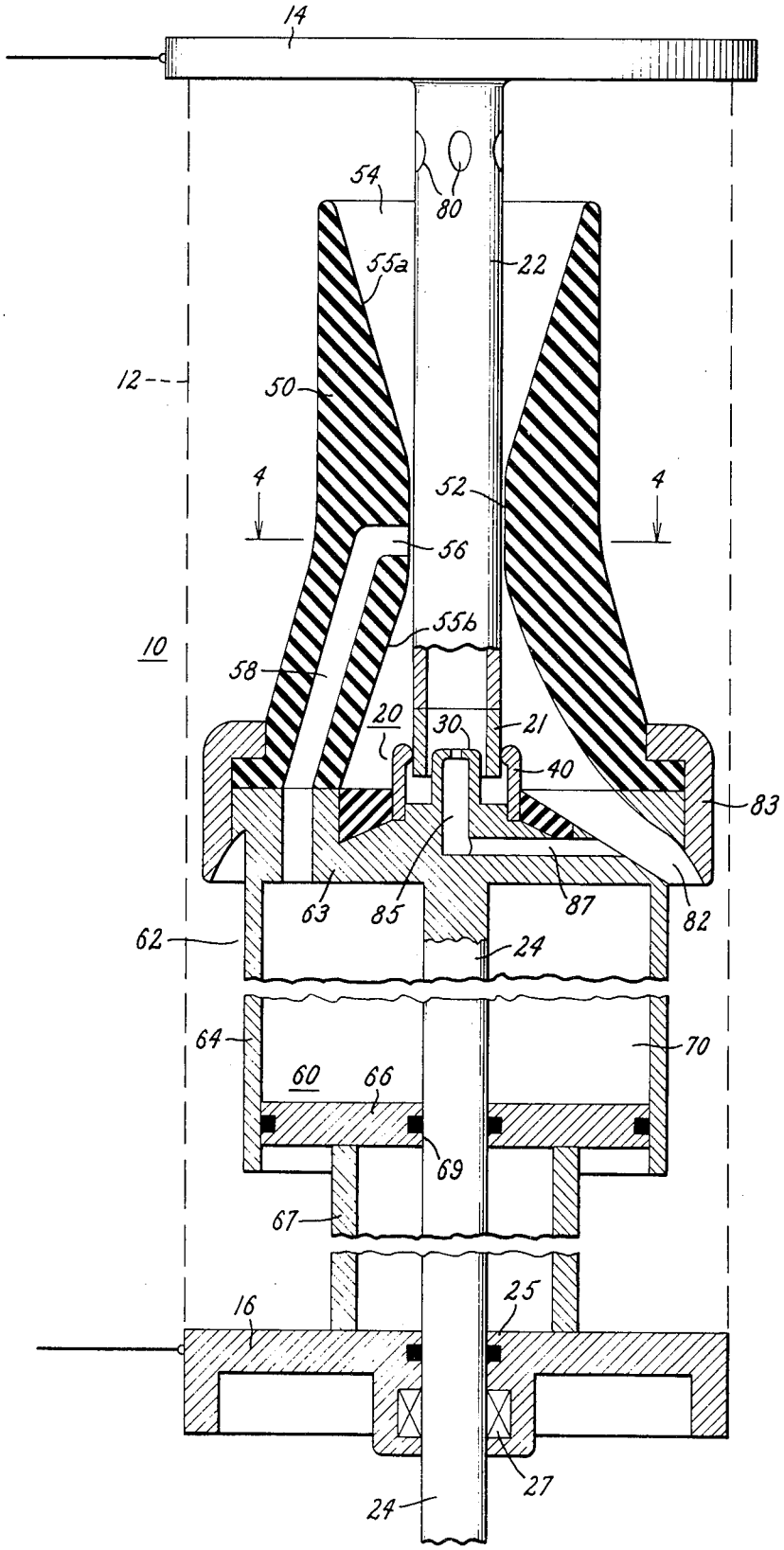
FIG. 1 is a side elevational view mostly in section of a puffer type circuit breaker embodying one form of the invention. The circuit breaker is shown in its closed position.

Referring now to FIG. 1, the illustrated circuit breaker comprises an interrupter housing 10 that comprises a cylindrical casing of insulating material schematically shown at 12 and a pair of end caps 14 and 16 suitably sealed to casing 12 at its opposite ends. The end caps act as opposed electrical terminals of the circuit breaker.

The circuit breaker further comprises a pair of separable electrodes in the form of contacts 20 and 21 located within the interrupter housing 10. Upper electrode 21 is a stationary contact carried by a conductive contact rod 22 suitably joined to upper end cap 14. Lower electrode 20 is a movable contact carried by a movable conductive contact rod 24 that extends through lower end cap 16. A suitable guide 25 on lower end cap 16 guides contact rod 24 for vertical reciprocating motion. Conventional sliding contacts, schematically shown at 27, provide an electrical connection between movable contact rod 24 and lower end cap 16.

The entire housing 10 is filled with a suitable arc-extinguishing gas at a moderate pressure, e.g., sulphur hexafluoride at a pressure of about 50 p.s.i. gauge.

The lower contact 20 comprises a centrally-disposed hollow arcing terminal 30 and a tulip-type contact assembly 40 surrounding arcing terminal 30. Tulip-type assembly 40 comprises a plurality of circumferentially-spaced fingers which are adapted to slidably engage the outer periphery of the stationary tubular contact 21 during initial contact-opening movement and during final contact-closing movement.

Figure 2:
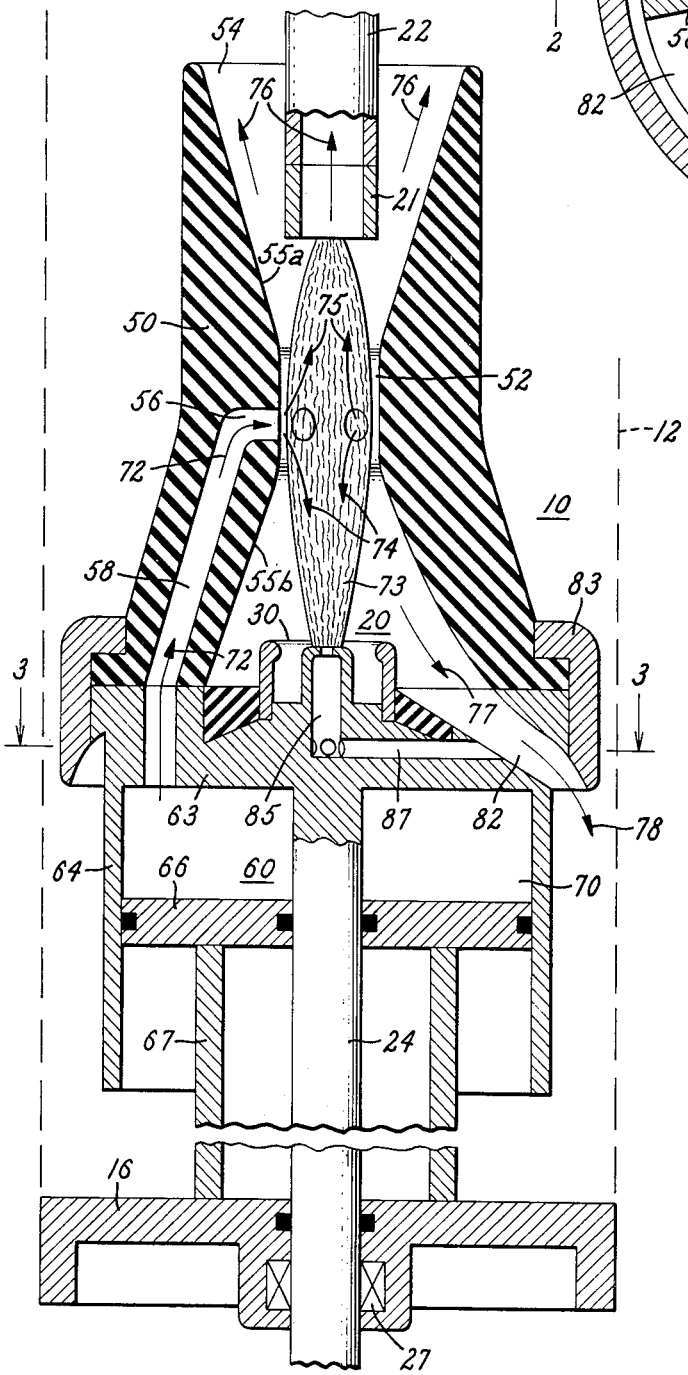
FIG. 2 is a side elevational view similar to that of FIG. 1 except showing the circuit breaker in a partially open position through which it passes during an interrupting operation.
Figure 4:
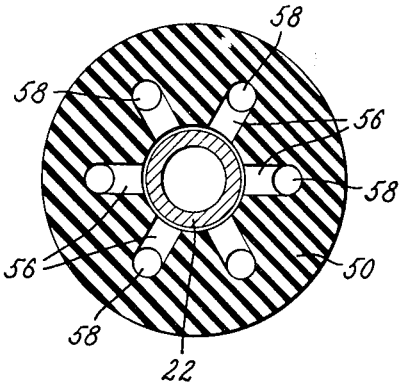
FIG. 4 is a sectional view along the line 4—4 of FIG. 1.

As will soon appear in greater detail, opening of the circuit breaker is effected by driving movable contact rod 24 in a downward direction from its position of FIG. 1 through its position of FIG. 2 into its fully-open position (not shown), thereby separating contacts 20 and 21. Closing is effected by returning movable contact 20 upwardly through its position of FIG. 2 into its closed position of FIG. 1.

Surrounding contacts 20 and 21 is a nozzle 50 of electric insulating material having a flow passage 54 extending therethrough. Intermediate its ends, nozzle 50 has a portion 52, referred to herein as its throat, where the flow passage 54 has its smallest cross-section. At axially opposed sides of the throat 52, the flow passage has divergent sections 55*a* and 55*b*. Extending radially of the body of the nozzle 50 and intersecting throat 52 at their inner ends are a plurality of injection passages 56 through which arc-extinguishing gas can be injected into the throat region of the nozzle, as will soon be described. The injection passages 56 are fed through feed passages 58 communicating with the injection passages and extending through the nozzle body between the injection passages and the lower end of the nozzle.

For developing the desired pressure for forcing gas through passages 58, 56, a pump, or puffer, 60 is provided at the lower end of the nozzle. This pump 60 comprises a metal cylinder 62 comprising a horizontal end wall 63 and a cylindrical portion 64 projecting downwardly from the end wall. The end wall 63 is coupled to the movable contact rod 24 and carries the movable contact 20.

Pump 60 further comprises a stationary piston 66 slidably received within the cylindrical portion 64. The piston 66 is mounted on lower end cap 16 by means of a metal support tube 67. The movable contact rod 24 passes through a central opening 69 in the piston and is free to slide therein. A suitable seal prevents gas leakage through opening 69.

The cylinder space 70 between piston 66 and end wall 63 is normally filled with arc-extinguishing gas. When the cylinder 62 is driven downwardly with movable contact rod 24 during a circuit-breaker opening operation, the gas in cylinder space 70 is compressed, thus forcing pressurized gas upwardly through the passages 58, 56 into the throat region of the nozzle, as indicated by arrows 72 of FIG. 2, assuming that the throat is not then blocked.

At the same time that the pump is developing pressure as above-described, the contacts 20 and 21 are separating and an arc 73 is being drawn therebetween that extends within the throat 52 of flow passage 54, as shown in FIG. 2. During the initial portion of the opening operation, the flow of arc-extinguishing gas through the passages 58, 56 is blocked by the presence of stationary contact structure 22, 21 in the throat 52 of the nozzle, thus providing for a substantial pressure build-up in cylinder space 70. But after the nozzle has been moved downwardly sufficiently to carry the throat 52 into a position beneath the lower tip of contact 21, the throat is unblocked and the pressurized arc-extinguishing gas is free to enter the throat 52 and follow the flow paths indicated by arrows 74–78 of FIG. 2. That is, upon entering the throat, a portion of the arc-extinguishing gas flows axially of the arc toward the upper electrode 21, and the remaining portion flows axially of the arc downwardly toward the lower electrode 20. In view of this division of the blast into two oppositely directed streams, the nozzle may be thought of as a dual flow nozzle.

As indicated by arrows 76 (FIG. 2), most of the upwardly-flowing portion of the arc-extinguishing blast flows out of the upper end of the nozzle 50, but part flows upwardly through the hollow stationary electrode discharging through the exhaust ports 80 of FIG. 1. The downwardly-flowing portion of the blast follows path 74, 77, discharging from the flow passage 54 via a plurality of lower exhaust ports 82. These lower exhaust ports 82 extend transversely of the nozzle flow passage 54, passing through both the nozzle wall and the end wall 63 of the cylinder 62. The inner ends of these exhaust ports 82 are located in a region surrounding the lower electrode 20. The divergent section 55*b* of flow passage 54 defines a flow zone about the exterior of electrode 20 leading to the exhaust ports 82. As shown in FIG. 2, there is an annular baffle 83 at the outer end of the discharge ports 82 that serves to direct the arcing products more effectively downward so as to minimize the chances that the space between the electrodes 20 and 21 located externally of the nozzle will have its dielectric strength weakened by these discharging arcing products.

Figure 3:
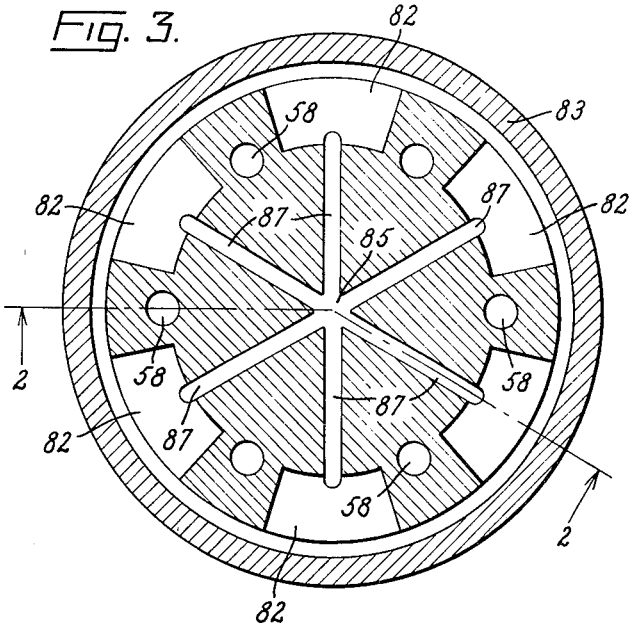
FIG. 3 is a sectional view along the line 3—3 of FIG. 2.

Referring especially to FIG. 3, it is to be noted that the exhaust ports 82 are disposed in locations circumferentially-spaced from the feed passages 58, thus allowing discharge through the ports 82 without interference from feed passages 58. The exhaust ports 82 are oriented so that gas flowing from flow passage 54 into the exhaust ports changes its direction of flow gradually and by substantially less than 90°. This substantially reduces stagnation at the entrance to the exhaust ports, particularly in the electrically-stressed region where electrode 20 is located.

For further reducing stagnation in the region of electrode 20, the arcing terminal 30 is provided with a central passage 85 extending therethrough and communicating with the exhaust ports 82 through discharge ducts 87. Some of the downwardly flowing portion of the arc-extinguishing blast follows a path through the passages 85, 87, thus reducing stagnation in the electrically stressed regions just above the arcing terminal 30.

It will be apparent from the above description that I have been able to provide substantially the same desirable flow pattern as in my aforesaid patent, i.e., injecting the blast radially into the throat and forcing portions of the blast to flow from the throat in opposite directions axially of the arc toward the spaced electrodes. It should also be apparent that I have been able to provide this desirable flow pattern with a conventional puffer (60) located at one end of the nozzle 50, thus eliminating the need for a pump, or puffer, surrounding the nozzle, such as present in my aforesaid patent. One feature that contributes importantly to my being able to retain the desired flow pattern despite the presence of a pump at one end of the nozzle is the presence at this one end of the transversely-extending exhaust ports 82 disposed between the feed passages 58 in circumferentially-spaced relationship to the feed passages.

An advantage of providing exhaust ports (82) exteriorly of the electrode 20, instead of confining the exhaust route to a passage through the electrode 20, is that the size of the electrode 20 imposes no significant limitation on the desired maximum effective cross-section of the exhaust ports. In other words, I can within certain practical limits, make these exhaust ports as large as desired in order to induce the desired proportion of the gas blast to flow downwardly in the flow passage past the lower electrode 20.

Another advantage of using pumping structure of the type illustrated is that no involved linkage is needed, as in my aforesaid patented interrupter, for coupling the movable element (62) of the pump to the movable contact rod (24). These parts (62, 24) can be integrally connected together so that they move as a single unit.

To assure a relatively high pressure in the nozzle throat region, this region should constitute the principal flow restriction for the arc-extinguishing gas being injected through passages 56. If the principal flow restriction was constituted by the passages 56, then sonic flow would occur in the passages 56 and supersonic flow in the throat 52, which would result in reduced pressure in the throat area. To preclude this condition from occurring, I make the effective cross-sectional area of the throat 52 smaller than the total effective cross-sectional area of the passages 56 in their regions of minimum cross-section. For similar reasons, the effective cross-sectional area of the throat is smaller than the total effective cross-sectional area of the exhaust ports 82.

While I have shown and described a particular embodiment of my invention, it will be obvious to those skilled in the art that various changes and modifications may be made without departing from my invention in its broader aspect; and I, therefore, intend herein to cover all such changes and modifications as fall within the true spirit and scope of my invention.

What I claim as new and desire to secure by Letters Patent of the United States is:

1. A puffer-type gas-blast circuit breaker comprising:

a. a pair of electrodes, spaced apart during an interrupting operation, between which an arc is established, b. a dual-flow nozzle having a body primarily of electrical insulating material, a flow passage extending axially through said nozzle, through which said arc extends during an interrupting operation, said flow passage containing a throat of electrical insulating material and divergent sections at axially opposed sides of said throat, c. a plurality of injection passages extending generally radially of said nozzle in the region of said throat and intersecting said throat at the inner ends of said injection passages, d. a plurality of feed passages located within said nozzle body, communicating with said injection passages, and extending between said injection passages and one end of said nozzle, e. pump means located at said one end of said nozzle and operable during a circuit-breaker opening operation for injecting arc-extinguishing gas through said feed passages and said injection passages into said throat, f. and means for forcing the gas injected into said throat to flow within said flow passage axially of said arc in two streams directed in opposite directions from said throat toward said electrodes, said means comprising a plurality of exhaust ports at said one end of the nozzle extending transversely of said flow passage from said flow passage to the exterior of said nozzle in locations circumferentially spaced from said feed passages, the inner ends of said exhaust ports being disposed in a region surrounding one of said electrodes, one of said divergent sections defining a flow zone about the exterior of said one electrode leading to said exhaust ports.

2. The puffer-type circuit breaker of claim 1 in which:

a. said pump comprises a cylinder having an end wall fixed to said nozzle at said one end of the nozzle and a piston slidably received within said cylinder, b. said cylinder is coupled to one of said electrodes for movement therewith, c. opening motion of said one electrode causes said cylinder end wall to move toward said piston, thereby compressing the gas in the space between said piston and said cylinder end wall and producing flow through said feed passages and said injection passages into said throat.

3. The circuit breaker of claim 1 in which said exhaust ports extend from said flow passage to the exterior of said nozzle via paths that are oriented so that gas in flowing from said flow passage into said exhaust ports changes its direction of flow by substantially less than 90 degrees, thereby reducing stagnation at the entrance to said exhaust ports as compared to that which would result from a more pronounced change in direction.

4. The circuit breaker of claim 3 in combination with deflector means near the outer end of said exhaust ports for deflecting the arcing products discharging from said exhaust ports in a direction axially of said nozzle away from the space between said electrodes.

5. The circuit breaker of claim 1 in which:

a. said one electrode has an opening extending generally axially therethrough, and b. ducts are provided for interconnecting said opening and said exhaust ports to allow flow through said opening into said exhaust ports, which flow acts to reduce stagnation in the arcing region ahead of said one electrode.

* * * * *